US006058727A

United States Patent [19]

Fraser, Jr. et al.

[11] Patent Number: 6,058,727

[45] Date of Patent: May 9, 2000

[54] REFRIGERATION SYSTEM WITH INTEGRATED OIL COOLING HEAT EXCHANGER

[75] Inventors: Howard H. Fraser, Jr., Lafayette; Russell G. Lewis, Manlius; Michael F. Taras, Fayetteville, all of N.Y.

[73] Assignee: Carrier Corporation, Syracuse, N.Y.

[21] Appl. No.: 08/994,224

[22] Filed: Dec. 19, 1997

[51] Int. Cl.[7] ..... F25B 31/00; F25B 43/02

[52] U.S. Cl. ..... 62/190; 62/473; 62/513

[58] Field of Search ..... 62/192, 503, 513, 62/473, 190

[56] References Cited

U.S. PATENT DOCUMENTS

| | | | |
|---|---|---|---|
| 3,621,673 | 11/1971 | Foust . | |
| 4,208,887 | 6/1980 | Morse et al. . | |
| 4,217,765 | 8/1980 | Ecker . | |
| 4,316,366 | 2/1982 | Manning | 62/513 X |
| 4,488,413 | 12/1984 | Bottum . | |
| 4,938,036 | 7/1990 | Hougkins et al. . | |
| 5,245,833 | 9/1993 | Mei et al. | 62/503 X |

FOREIGN PATENT DOCUMENTS

| | | | |
|---|---|---|---|
| 404187957 | 7/1992 | Japan | 62/473 |
| 406123500 | 5/1994 | Japan | 62/473 |

*Primary Examiner*—William Wayner

[57] ABSTRACT

A refrigeration system for cooling air is disclosed. The system includes a substantially liquid refrigerant and an evaporator for transferring heat from the air to the substantially liquid refrigerant. The substantially liquid refrigerant becomes a low temperature, low pressure first substantially gaseous refrigerant. A compressor compresses the first substantially gaseous refrigerant into a high pressure, high temperature superheated second gaseous refrigerant. A lubricant circuit supplies lubricant to the compressor. A condenser rejects heat from the second gaseous refrigerant and forms a high pressure, lower temperature sub-cooled liquid refrigerant. The condenser has an output stream. A metering device transforms the sub-cooled liquid refrigerant into the substantially liquid refrigerant for the evaporator. A heat exchanger receives the first substantially gaseous refrigerant as a coolant on route to the compressor. The first substantially gaseous refrigerant is relatively cooler than the lubricant and the sub-cooled liquid refrigerant. The lubricant via the lubricant circuit flows through the heat exchanger and cools prior to entering the compressor and the sub-cooled liquid refrigerant flowing through the heat exchanger means sub-cools prior to entering the metering device.

10 Claims, 2 Drawing Sheets

REFRIGERATION SYSTEM WITH INTEGRATED OIL COOLING HEAT EXCHANGER

TECHNICAL FIELD

This invention is directed to refrigeration systems, and more particularly, to a refrigeration system having an improved oil cooling heat exchanger for lowering the discharge temperature of the compressor thus increasing compressor reliability and for increasing the viscosity of the oil to enhance system performance.

BACKGROUND ART

Conventional air conditioning systems cool air in confined spaces by using four main components, including a compressor, condenser, metering device, and an evaporator. These components also provide the basis for most refrigeration cycles. However, as systems become more technologically advanced, additional components are added. Generally, the compressor compresses refrigerant gas to a high pressure, high temperature, superheated gaseous state for use by the condenser. The condenser, in cooling the superheated gas, produces a sub-cooled liquid refrigerant with a high pressure and lower temperature. The metering device, such as an expansion valve, produces a low temperature, low pressure saturated liquid-vapor mixture from the sub-cooled liquid. Finally, the evaporator converts the saturated liquid-vapor mixture, to a low temperature, low pressure superheated gas during air cooling for use by the compressor. The overall performance and efficiency of refrigeration cycles are directly dependent upon the heat transfer provided by the condenser, evaporator, and compressor oil cooler. The overall performance is further dependent upon the performance and lubrication of the compressor.

During operation, most compressors use lubricants which reduce wear and/or seal gaps in the compressor to prevent internal refrigerant leakage. By maintaining the compressor lubricants at relatively low temperature, compressor efficiency and reliability are increased, providing improved lubricant sealing properties due to increased oil viscosity, improved compressor cooling, and decreased frictional wear. For example, screw type compressors utilize counter-rotating rotors to compress refrigerant gas. Such compressors rely on lubricants to reduce friction between mating parts and seal gaps between the rotors and crankcase thereof. Typically, the refrigerant includes some amount of the acquired lubricants before entering the compressor, but some rotating compressor technology injects the oil into the compression process separately.

More particularly, refrigerant enters a compressor in vapor form and is compressed, thereby increasing in pressure and temperature. The compressor releases the refrigerant and lubricant mixture and the mixture subsequently travels throughout the refrigeration system via a series of closed conduits. In some refrigeration cycles, the refrigerant and lubricant mixture exits the compressor and enters an oil separator. The oil is separated from the refrigerant and the refrigerant is routed to a condenser where the heat removal operation via a cooling medium such as outdoor air, occurs on the refrigerant. With heat removed, the refrigerant exits the condenser at high pressure and lower temperature. The compressor lubricant flows through an oil cooler, such as a heat exchange apparatus, similar to the condenser, wherein air is the cooling medium. The cooled oil flows back to the compressor, functioning to lower the refrigerant discharge temperature and increase the efficiency of the compressor. The refrigerant flows from the condenser to the metering device, such as an expansion valve, wherein temperature and pressure of the refrigerant are reduced for subsequent use by the evaporator and results in cooling of the air of the desired space. Between the condenser and the evaporator, refrigeration cycles such as this may also include an economizer circuit for use in further cooling of the main refrigerant stream. In such cases, an economizer heat exchanger is provided through which the main refrigerant stream passes for cooling. A secondary refrigerant flow off-shooting from the main line exiting the condenser is passed through an auxiliary metering device for achieving intermediate pressure and temperature refrigerant. This refrigerant is used in further sub-cooling of the main refrigerant flow prior to its passage through the metering device. With the main liquid refrigerant stream cooled in this manner, it can be used in another heat exchange mechanism for further lowering its temperature at the expense of the refrigerant gas traveling from the evaporator to the suction port of the compressor.

As indicated above, typically oil is cooled by using a separate oil cooler. However, the prior art does include refrigeration systems which combine the oil cooling with other cooling steps in a simultaneous process. For example, U.S. Pat. 5,570,583 discloses the integration of an oil cooler with a refrigerant condenser. The system uses the refrigerant to cool the compressor lubricant. However, a parasitic loss of compressor capacity occurs because the m?in refrigerant stream is used to directly cool the oil and in the process, evaporates a certain amount of refrigerant, reducing available sub-cooling. Accordingly, the required compressor power is increased by some amount and the useful system capacity is decreased. The use of separate oil coolers, in the form of separate heat exchangers as described above, substantially adds to the part count of refrigeration systems, as well as requiring the use of additional refrigeration circuits or additional external energy source to accomplish cooling. However, the shortcomings of current systems of this type deplete efficiency of the overall refrigeration system.

There exists a need, therefore, for an improved refrigeration cycle including a more efficient design for cooling the compressor lubricant.

DISCLOSURE OF INVENTION

The primary object of this invention is to provide an improved refrigeration system, having a refrigeration cycle with more efficient means for cooling the compressor lubricant.

Another object of this invention is to provide an improved heat exchanger for use in a refrigeration system, which heat exchanger simultaneously cools both the compressor lubricant and the main refrigerant flow.

Still another object of this invention is to provide an improved refrigeration system having an accumulator which includes a heat exchanger with at least two heat exchange circuits for simultaneously cooling the main refrigerant stream as well as the compressor lubricant.

Yet another object of this invention is to provide an improved accumulator design, having a refrigerant cooling circuit submerged in accumulated liquid refrigerant and an oil cooling circuit placed in a vapor section of the accumulator.

The foregoing objects and following advantages are achieved by the refrigeration system for cooling air, of the present invention. The system includes a substantially liquid refrigerant and an evaporator for transferring heat from the air to the substantially liquid refrigerant. The substantially liquid refrigerant becomes a low temperature, low pressure first substantially gaseous refrigerant. A compressor compresses the first substantially gaseous refrigerant into a high pressure, high temperature superheated second gaseous refrigerant. A lubricant circuit supplies lubricant to the compressor. A condenser rejects heat from the second gaseous refrigerant and forms a high pressure, lower temperature sub-cooled liquid refrigerant. The condenser has an output stream. A metering device transforms the sub-cooled liquid refrigerant into the substantially liquid refrigerant for the evaporator. A heat exchanger receives the first substantially gaseous refrigerant as a coolant on route to the compressor. The first substantially gaseous refrigerant is relatively cooler than the lubricant and the sub-cooled liquid refrigerant. The lubricant via the lubricant circuit flows through the heat exchanger and cools prior to entering the compressor and the sub-cooled liquid refrigerant flowing through the heat exchanger means sub-cools prior to entering the metering device. In a particular embodiment, the system includes a sub-cooled liquid refrigerant, which is sub-cooled further by directing it through an accumulator/heat exchanger before entering a metering device. A metering device transforms the sub-cooled liquid refrigerant into a substantially liquid, low pressure, low temperature refrigerant mixture which enters an evaporator, where heat transfer from the refrigerated space air to the substantially liquid refrigerant mixture occurs. The substantially liquid refrigerant mixture becomes a low temperature, low pressure first saturated refrigerant. The first saturated refrigerant enters the accumulator/heat exchanger where it sub-cools the substantially liquid refrigerant headed to the metering device and simultaneously cools the compressor lubricant flow thus becoming a second saturated refrigerant vapor. The lubricant circuit carries hot compressor oil out of an oil separator through the accumulator/heat exchanger where its temperature is substantially reduced and returns this cooled lubricant to the compressor. The second saturated refrigerant vapor leaves the accumulator/heat exchanger and is supplied to the compressor in superheated gaseous form to start the compression process. The compressor compresses the superheated gaseous refrigerant into a high pressure, high temperature further superheated gaseous refrigerant. During the compression process the lubricant and refrigerant gas are mixed together. The oil separator extracts oil from the further superheated gaseous refrigerant and directs it to the accumulator/oil cooler. This completes the oil circuit. The further superheated gaseous refrigerant enters a condenser, where heat is rejected from it to outdoor air and the further superheated gaseous refrigerant becomes the high pressure, lower temperature sub-cooled liquid. Then this sub-cooled liquid refrigerant stream is split into two flows. The main refrigerant flow is directed to the economizer heat exchanger for further sub-cooling and completes the main refrigerant circuit. The secondary flow is routed through an auxiliary metering device to become an intermediate pressure, intermediate temperature refrigerant mixture and is used for the main flow sub-cooling in the economizer heat exchanger. This refrigerant mixture becomes intermediate pressure, intermediate temperature superheated gas at the economizer heat exchanger outlet and is forwarded to the compressor intermediate pressure port to complete an economizer circuit.

BEST MODE FOR CARRYING OUT THE INVENTION

Figure 1:
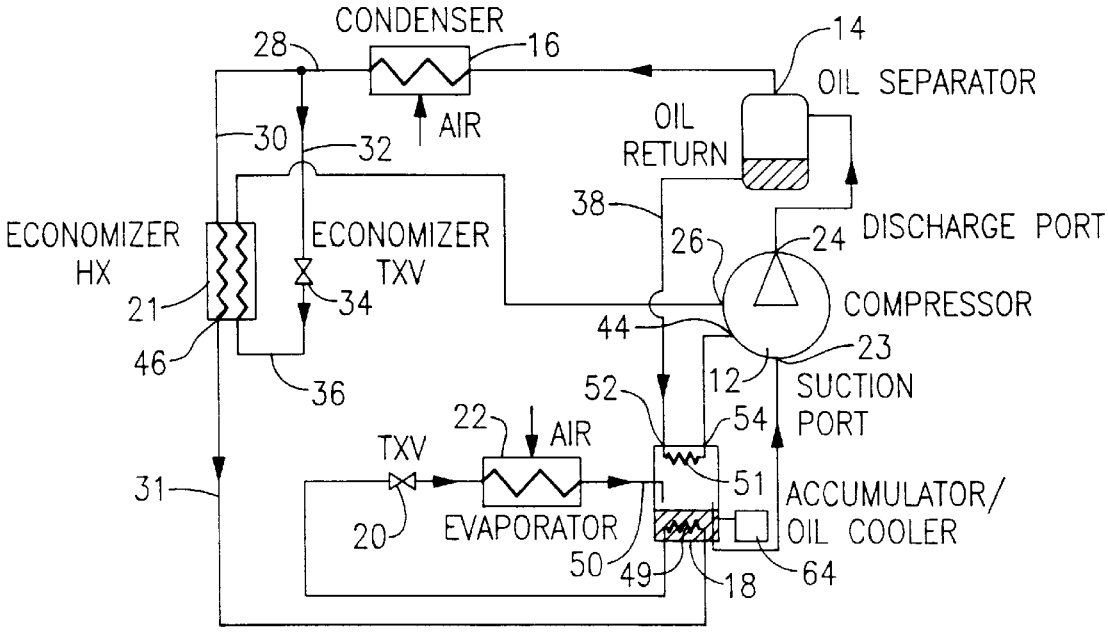
FIG. 1 is a schematic representation of the refrigeration system in accordance with the principles of the present invention, which system uses an accumulator/heat exchanger for cooling both the main refrigerant stream and the compressor lubricant.

Referring to FIG. 1, shown is the refrigeration system and cycle of the present invention, designated generally as 10. System 10 generally includes a compressor 12, an oil separator 14, a condenser 16, an integrated accumulator/heat exchanger 18, a metering device 20, an economizer heat exchanger 21, and an evaporator 22. The main four elements of a refrigeration system, including the compressor, the condenser, metering device and evaporator are arranged, from a general standpoint, in a manner known in the art for all refrigeration systems.

Compressor 12, which may be in the form of a screw, rotary, reciprocal or scroll compressor, includes a suction port 23 for receiving a low temperature, low pressure gaseous refrigerant from accumulator/heat exchanger 18. This gaseous refrigerant is compressed in compressor 12 which outputs the high temperature, high pressure superheated gas to oil separator 14 from outlet port 24. Compressor 12 also includes an intermediate port 26 receiving refrigerant sent through an economizer circuit, originating at the output of condenser 16, which is at an intermediate temperature and pressure. The refrigerant exists compressor 12 into oil separator 14, wherein compressor lubricant typically is separated from the refrigerant and then returned to the compressor, as discussed in more detail below. The refrigerant then enters condenser 16, wherein the refrigerant is de-superheated, condensed, and sub-cooled through a heat exchange process with ambient air to a lower temperature, high pressure, sub-cooled liquid. The liquid refrigerant exits condenser 16 at outlet 28, where it is split into two streams. The two streams include the main refrigerant stream 30 and the economizer refrigerant stream 32. The economizer refrigerant stream 32 flows through an auxiliary thermal expansion valve 34 and exits valve 34 as economizer stream 36 as an intermediate temperature, intermediate pressure saturated liquid-vapor mixture. This saturated liquid-vapor mixture exiting valve 34 is used as the coolant in economizer heat exchanger 21. The main refrigerant stream 30 flows in the opposite direction of the economizer refrigerant stream 36 to provide a counter-flow arrangement for better heat transfer. The main refrigerant stream 31 exits heat exchanger 21 at outlet 46 on route to evaporator 22. Heat exchanger 21 may be in the form as known in the art and preferably is a brazed plate or tube-in-tube heat exchanger design.

Figure 2:
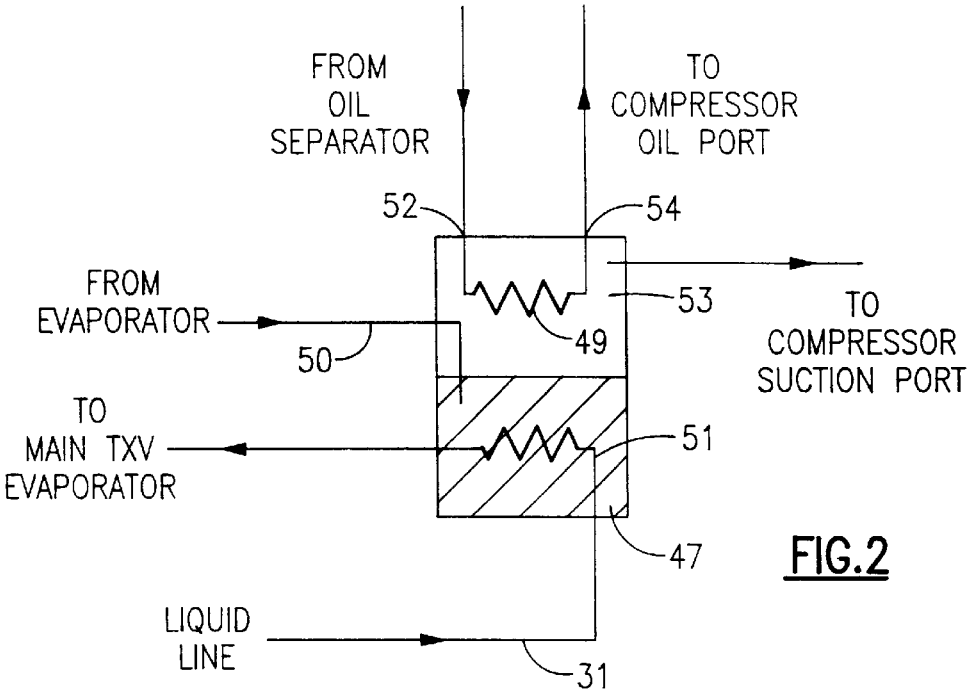
FIG. 2 is a more detailed view of the accumulator/heat exchanger shown in FIG. 1.

The refrigerant from outlet 46 flows in stream 31 from heat exchanger 21 into accumulator/heat exchanger 18 for further sub-cooling prior to entering metering device 20. The refrigerant is cooled by the low pressure, low temperature, saturated refrigerant exiting evaporator 22 and accumulating in the accumulator for liquid evaporation, on route to compressor 12. Heat exchange with the accumulated refrigerant is facilitated by a first heat exchanger circuit 49. First circuit 49 is submerged, as shown in FIG. 2, in the liquid refrigerant section 47 in accumulator/heat exchanger 18.

The refrigerant exits heat exchanger circuit 49 of accumulator/heat exchanger 18 and enters metering device 20, which is preferably in the form of a thermal or electronic expansion valve, and exits the expansion valve as a low temperature and low pressure saturated liquid-vapor mixture. The air to be cooled by system 10 flows through evaporator 22 in a heat exchange relationship with the liquid-vapor refrigerant mixture entering evaporator 22 from the metering device 20. Refrigerant in evaporator 22 changes from a saturated liquid-vapor mixture state to a saturated substantially gaseous state due to its low boiling temperature and the temperature differential between the lower temperature refrigerant and the air being cooled. The saturated substantially gaseous refrigerant exits evaporator 22 in line 50 and flows to the accumulator 18, where any liquid is allowed to boil away before the refrigerant enters the compressor, as indicated above, and flows onward to compressor 12 through suction port 23. The accumulator/heat exchanger 18 also cools the oil lubricating compressor 12. The oil is cooled in a unique manner via flow through the accumulator, in a second heat exchanger circuit 51, as the lower temperature saturated gaseous refrigerant accumulates therein. That is, oil flows from oil separator 14 in stream 38 and enters accumulator/heat exchanger 18 at port 52. The cooled oil flows through the second heat exchanger circuit 51 of the accumulator with the saturated vapor refrigerant accumulated therein, as described above and is cooled. The circuit 51 is positioned in the vapor section 53, as shown in FIG. 2, of accumulator/heat exchanger 18. The oil exits accumulator/heat exchanger 18 at port 54 and returns to the compressor through port 44. Through this arrangement, the oil used to lubricate compressor 12 is cooled in a unique manner via accumulator/heat exchanger 18 by a counter-flow arrangement with the coolant therein. That is, through cooling, the oil viscosity is increased, becoming a more efficient friction reducing and more efficient sealing medium as well as allowing for cooler operation of the mechanical components of the compressor, thus increasing its reliability and overall system performance.

Figure 3:
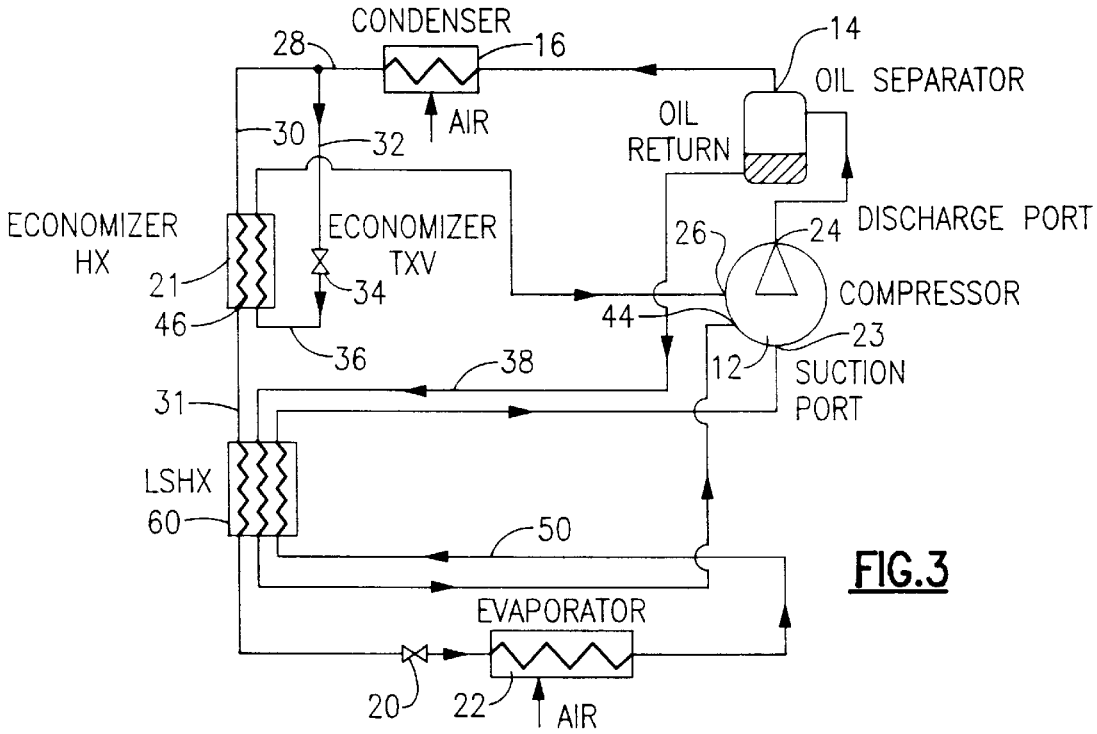
FIG. 3 is a schematic representation of another embodiment of a refrigeration system in accordance with the principles of the present invention, using a liquid line-suction line heat exchanger in place of the accumulator for cooling the main stream and compressor lubricant

In an alternative embodiment shown in FIG. 3, the main stream of refrigerant flows from outlet 46 from economizer heat exchanger 21 into liquid line-suction line heat exchanger (LSHX) 60. In this embodiment, LSHX 60 is used as the oil cooler in place of the accumulator/heat exchanger 18, prior to the main stream 31 of refrigerant entering evaporator 22. As shown in FIG. 3, the oil or lubricant circuit 62 enters LSHX 60, along with the main refrigerant line exiting heat exchanger 18, each in a counter-flow direction relative to the flow of the low temperature, low pressure superheated refrigerant gas exiting evaporator 22 in line 50. In a heat exchange process, both the main refrigerant stream 31 and the oil stream 38 are cooled in LSHX 60, the main refrigerant stream on route to the evaporator and the cooled oil on route to the compressor. Further superheated low temperature, low pressure refrigerant gas is directed to the compressor from LSHX 60, as well.

In operation, the refrigerant in the saturated gaseous state enters the compressor while the compressor is lubricated via cooled oil entering port 44. During compression process, the refrigerant combines with refrigerant from intermediate port 26, exits compressor 12 at outlet 24 and enters oil separator 14. Oil is separated from the refrigerant and returned to compressor 12 after being cooled in accumulator/heat exchanger 18. Refrigerant flows from oil separator 14 into condenser 16 and leaves condenser 16 in a lower temperature, high pressure sub-cooled liquid state. The sub-cooled liquid is split into the main refrigerant stream 30 and the economizer stream 32. The economizer refrigerant stream 32 flows into an auxiliary thermal expansion valve 34 and leaves valve 34 in stream 36 as an intermediate temperature and intermediate pressure saturated liquid-vapor mixture. The refrigerant then flows as stream 36 in this state into economizer heat exchanger 21, acting as the cooling medium for that heat exchanger. After performing cooling in heat exchanger 21, the refrigerant is returned to compressor 12 through intermediate port 26. The main refrigerant stream 30 passes through heat exchanger 21 and is cooled by the refrigerant in economizer stream 36 flowing in a counter-flow arrangement. The main refrigerant stream 31 exits heat exchanger 21 in a cooler state on route to accumulator/heat exchanger 18 for sub-cooling in the first, refrigerant-submerged heat exchange circuit 49. Oil, from oil separator 14, enters accumulator/heat exchanger 18, in the second, vapor positioned heat exchange circuit 51, similar to the refrigerant in main line 31, and is cooled by the accumulated and cooler saturated refrigerant vapor. Oil returns to compressor 12 through port 44 at a lower temperature and higher viscosity for cooling the compressor, achieving improved sealing capabilities and reducing friction among the mechanical components of the compressor. In finishing the refrigeration cycle, the refrigerant flows from economizer heat exchanger 21, is sub-cooled in accumulator/heat exchanger 18, flows through metering device 20, exiting therefrom at a low temperature, low pressure saturated, substantially liquid, liquid-vapor mixture. A control device 64 for measuring liquid refrigerant sub-cooling is provided at an outlet of said accumulator and means for controlling liquid refrigerant level in said accumulator. This mixture enters evaporator 22 whereby, as indicated in the beginning, it is boiled through a heat exchange arrangement. Finally, the refrigerant exits evaporator 22 to accumulator/heat exchanger 18, on route to compressor 12, as described.

The operation of the second embodiment is similar to as described above with the exception that the accumulator performing of the cooling function is replaced by the LSHX performing the cooling function. Accordingly, the main stream of refrigerant exiting economizer heat exchanger 21 enters LSHX 60 along with oil in oil stream 38, originating from oil separator 14. The low temperature, low pressure superheated gaseous refrigerant exiting evaporator 22 in line 50 enters LSHX 60 in a counter-flow direction relative the oil from line 62 and main stream of refrigerant from stream 30, as shown in FIG. 2, and functions to cool the same, while on route to the compressor.

Accordingly, by combining two or more heat transfer processes in one heat exchanger, as above, they can be arranged in the most efficient manner through heat flux redistribution, which is not possible otherwise. There are some other side benefits obtained through this type of flow arrangement such as: lower compressor suction superheat, greater amount of sub-cooling, more efficient compressor and condenser operation, improved compressor reliability and enhanced overall system performance.

The primary advantage of this invention is that an improved refrigeration system is provided, having a refrigeration cycle with more efficient means for cooling the compressor lubricant. Another advantage of this invention is that an improved refrigeration system is provided having an accumulator, which includes a heat exchanger with two heat exchange circuits for simultaneous cooling of the main refrigerant stream as well as the compressor lubricant. Another advantage of this invention is that an improved accumulator for use in a refrigeration system is provided, which includes an integrated oil cooling circuit. Another advantage of this invention is that an improved accumulator design is provided, having a refrigerant cooling circuit submerged in accumulated liquid refrigerant and an oil cooling circuit placed in a vapor section of the accumulator. Although the invention has been shown and described with respect to the best mode embodiment thereof, it should be understood by those skilled in the art that the foregoing and various other changes, omissions, and additions in the form and detail thereof may be made without departing from the spirit and scope of the invention.

What is claimed is:

1. A refrigeration system for cooling air, comprising:

a substantially liquid refrigerant;

an evaporator for transferring heat from the air to said substantially liquid refrigerant, whereby said substantially liquid refrigerant becomes a low temperature, low pressure first substantially gaseous refrigerant;

a compressor for compressing said first substantially gaseous refrigerant into a high pressure, high temperature superheated second gaseous refrigerant;

a lubricant circuit for supplying lubricant to said compressor;

a condenser for rejecting heat from said second gaseous refrigerant and forming a high pressure, lower temperature sub-cooled liquid refrigerant, said condenser having an output stream;

a metering device for transforming said sub-cooled liquid refrigerant into said substantially liquid refrigerant for said evaporator; and a heat exchanger means for receiving said first substantially gaseous refrigerant as a coolant on route to said compressor, wherein said first substantially gaseous refrigerant is relatively cooler than said lubricant and said sub-cooled liquid refrigerant, said lubricant via said lubricant circuit flowing through said heat exchanger means for achieving cooling prior to entering said compressor and said sub-cooled liquid refrigerant flowing through said heat exchanger means for achieving sub-cooling prior to entering said metering device.

2. The system according to claim 1, wherein said heat exchanger means is an accumulator including a coolant path for receiving said first substantially gaseous refrigerant as a coolant and means for allowing evaporation of any liquid forming said first substantially gaseous refrigerant prior to entering said compressor.

3. The system according to claim 2, wherein said accumulator further includes a lubricant path for receiving said lubricant in a counter-flow direction relative to said first substantially gaseous refrigerant flowing through said coolant path, for cooling said lubricant and returning it to said compressor, and a sub-cooled liquid refrigerant path for receiving said sub-cooled liquid refrigerant in a counter-flow direction relative to said first substantially gaseous refrigerant flowing through said coolant path, for cooling said sub-cooled liquid refrigerant on route to said metering device.

4. The system according to claim 2, further including an economizer circuit originating from said output stream and having an economizer refrigerant flow to said compressor and an economizer heat exchanger for receiving and cooling said sub-cooled liquid refrigerant on route to said metering device, wherein said economizer refrigerant flow is used as a cooling medium in said economizer heat exchanger.

5. The system according to claim 1, wherein said heat exchanger means is a liquid line-suction line heat exchanger having a coolant path for said first substantially gaseous refrigerant, a lubricant path for receiving said lubricant in a counter-flow direction relative to said first substantially gaseous refrigerant flowing through said coolant path, for cooling said lubricant returning to said compressor, and a sub-cooled liquid refrigerant path for receiving said sub-cooled liquid refrigerant in a counter-flow direction relative to said first substantially gaseous refrigerant flowing through said coolant path, for further cooling said sub-cooled liquid refrigerant on route to said metering device.

6. The system according to claim 5, wherein said liquid line-suction line heat exchanger means has a brazed plate heat exchanger design.

7. The system according to claim 5, wherein said liquid line-suction line heat exchanger means has a tube-in-tube heat exchanger design.

8. The system according to claim 2, wherein said accumulator has a first section for accumulating liquid refrigerant and a second section for accumulating vapor refrigerant, further comprising a first cooling circuit positioned for submergence in liquid refrigerant in said first section for circulating and cooling said sub-cooled liquid refrigerant and a second cooling circuit positioned in said second section with said vapor refrigerant for circulating and cooling said lubricant.

9. The system according to claim 2, further including control means for measuring liquid refrigerant sub-cooling at an outlet of said accumulator and means for controlling liquid refrigerant level in said accumulator.

10. A heat exchanger for a refrigeration system using a lubricated compressor, a condenser, a metering device, and an evaporator, comprising:

a coolant circuit for circulating a liquid refrigerant and vapor refrigerant mixture in a first path on route to the compressor;

a lubricant circuit for circulating lubricant in a second path on route to said compressor for cooling via heat exchange with said coolant;

a refrigerant circuit for circulating refrigerant in a third path on route to the metering device for cooling via beat exchange with said coolant; and means for accumulating said liquid refrigerant of the mixture to allow the liquid refrigerant to transition into vapor prior to entering the compressor, wherein said means for accumulating includes a first section for accumulating liquid refrigerant and a second section for accumulating vapor refrigerant, further comprising a first cooling circuit positioned for submergence in liquid refrigerant in said first section for circulating and cooling said liquid refrigerant and a second cooling circuit positioned in said second section with said vapor refrigerant for circulating and cooling said lubricant.

* * * * *